United States Patent [19]

Wolk

[11] 3,980,551

[45] Sept. 14, 1976

[54] REFINING OF WASTE LUBE OIL TO PREPARE USABLE LUBESTOCK

[75] Inventor: Ronald H. Wolk, San Jose, Calif.

[73] Assignee: Hydrocarbon Research, Inc., Morristown, N.J.

[22] Filed: Dec. 18, 1975

[21] Appl. No.: 640,093

[52] U.S. Cl. ..... 208/179; 208/251 H

[51] Int. Cl.[2] ..... C10M 11/00

[58] Field of Search ..... 208/179, 251 H

[56] References Cited

UNITED STATES PATENTS

| | | | |
|---|---|---|---|
| 2,952,628 | 9/1960 | Fear | 208/251 H |
| 2,987,467 | 6/1961 | Keith et al. | 208/251 H |
| 3,893,911 | 7/1975 | Rovesti et al. | 208/251 H |
| 3,901,792 | 8/1975 | Wolk et al. | 208/251 H |

*Primary Examiner*—Delbert E. Gantz
*Assistant Examiner*—James W. Hellwege

[57] ABSTRACT

Waste lube oil is refined by treating it with hydrogen in an ebullated bed of catalyst particles and subjecting the liquid effluent to vacuum distillation or other equivalent separation procedures to produce a clean and usable lubestock and a heavy residue which contains the sludge and metallic ingredients in the waste lube oil. This process finds its greatest utility in recovering usable lubricant from a waste product.

3 Claims, 1 Drawing Figure

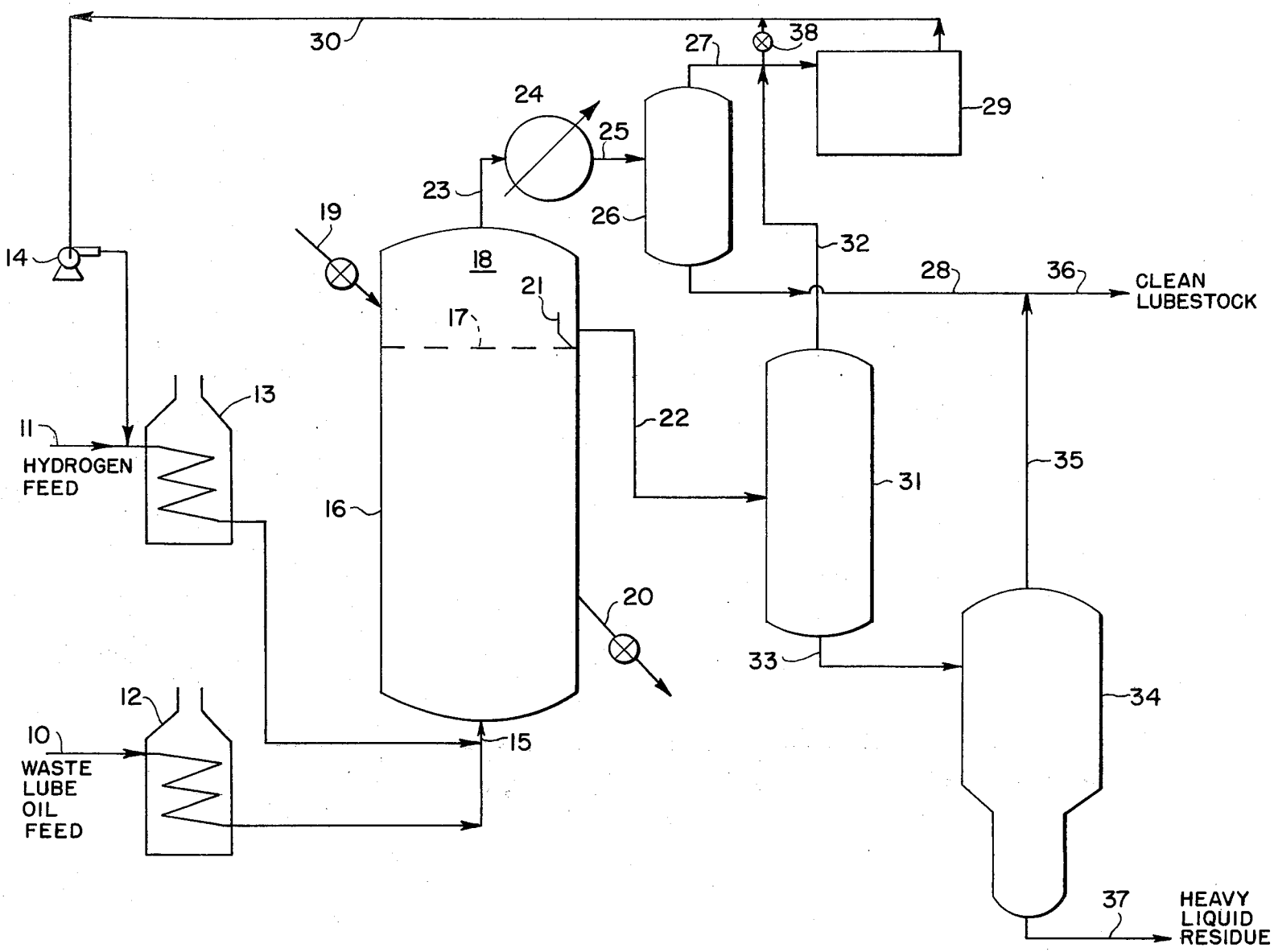
CLEAN LUBESTOCK
HEAVY LIQUID RESIDUE
HYDROGEN FEED
WASTE LUBE OIL FEED
10
11
12
13
14
15
16
17
18
19
20
21
22
23
24
25
26
27
28
29
30
31
32
33
34
35
36
37
38

REFINING OF WASTE LUBE OIL TO PREPARE USABLE LUBESTOCK

BACKGROUND OF THE INVENTION

Automobiles and other machines employing internal combustion engines require various lubricants such as crankcase oil, hydraulic transmission fluid, and the like, for the operation of the various components of the machines. Periodically these lubricants are drained from the engine and removed because they are dirty, they have acquired an undesirable acidity, and have developed a certain amount of sludge, all of which decreases the lubricating power of the material to such an extent that it is advisable to exchange it for new lubricant. The oils which have been drained from the engines are generally collected in automotive service stations and other locations and disposed of in any of a variety of ways. It is common to employ such materials as fuel, as a dressing for the surfaces of unpaved roadways or the material may be dumped as an unusable substance. Not only do these methods of disposal result in some pollution of the environment, but they also represent an economic squandering of dwindling petroleum resources. It has long been apparent that it would be desirable to recover the valuable components from these waste products and to do so with the minimum of pollution and expense.

THE PRIOR ART

One of the procedures employed in the past to treat waste lube oil has been the acid/clay process and improvements thereon. In such a process sulphuric acid dissolves certain undesirable components and leaves the paraffins and naphthenes with substantially no change. The treatment with clay is normally employed to remove components that cause off-color and to remove certain asphaltic or resinous materials. The byproducts produced from such a process are highly acidic, frequently foul smelling, and are otherwise objectionable to the extent that they present serious disposal problems. Distillation of waste lube oil provides some advantages but also some disadvantages over the earlier acid/clay treatment. Such a process provides only physical separations of materials and involves the use of costly equipment. Still other procedures include fixed-bed hydrotreatment, which requires a vacuum distillation pretreatment to remove metal-containing sludge in order to prevent catalyst degradation which would occur at an uneconomically rapid rate if the metals were not removed.

It is an object of the present invention to provide a single and economical process for refining waste lube oil to recover substantially all of the valuable portions thereof.

It is another object of this invention to provide a process for refining waste lube oil wherein the heavy metals in the oil are removed without the necessity of a vacuum distillation pretreatment.

It is another object of this invention to provide a hydrogenation process which causes the reformation of valuable hydrocarbons from the degraded lubricants produced by the high temperatures and violent forces involved in the internal combustion engine where the lubricant was employed.

It is still another object of this invention to provide an efficient process for accomplishing the desired results with as small an amount of heavy products as possible.

Still other objects will appear from the more detailed description of this invention which follows.

BRIEF DESCRIPTION OF THE INVENTION

The process of this invention involves subjecting the waste lube oil feed material to catalytic demetallization and hydrogenation in an ebullated bed process such as that described in U.S. Pat. No. 2,987,465 to Johanson and in U.S. Pat. No. 3,549,517 to Lehman. In such a process the reaction is accomplished in the liquid phase where the heated feed material and hydrogen are passed upwardly through a bed of catalyst particles at such a rate as to cause the particles to assume random motion. The liquid material is recycled from above the upper level of the catalyst particles to the entrance zone at the bottom of the catalyst bed at a sufficient velocity to ensure that the catalyst particles are always maintained in motion and are distributed throughout the moving liquid. A zone of liquid which is substantially free of catalyst particles remains at the top of the entire liquid in the reactor and from this zone there is withdrawn the liquid product from the reactor. A vapor space above the liquid level in the reactor provides a zone from which a vapor substantially free of liquid can be withdrawn overhead and treated to recover the values therein. Catalyst particles can be introduced into the ebullated bed at anytime during the reaction and spent catalyst particles can be removed from the ebullated bed at anytime during the reaction. This process is sometimes referred to as "hydrotreating".

A mixture of hydrogen and waste lube oil feed is heated to the desired reaction temperature and introduced into the bottom of the ebullated bed reactor along with suitable catalyst particles which will catalyze the hydrogenation of the lube oil and will effect the demetallization of the lube oil. Such metals would principally be expected to be lead from tetraethyllead. Of course other metals may be involved, e.g. those derived from modifiers, stabilizers, and so forth incorporated into the original lubricant. Two products are produced from the ebullated bed reactor, one of which is a vapor product and the other is a liquid product. The vapor product is principally hydrogen although light hydrocarbon vapors may also be included, such as methane, ethane, etc. This product is cooled and introduced into a separator which permits any entrained hydrocarbon liquid to be collected for incorporation into the desired lubestock product. The vapors and gases emanating from the separator are principally hydrogen and are recycled to the hydrogen feed to the reactor, although if desired they may be passed through a hydrogen purification unit to purify and concentrate the hydrogen before recycling. The liquid product from the ebullated bed reactor is subjected to a flash evaporation to remove dissolved hydrogen and light hydrocarbons which are combined with those similar vapors that are fed into the hydrogen purification unit. The liquid remaining from the flash evaporation step is fed to a vacuum distillation unit which produces a clean lubestock product overhead and a heavy liquid residue as a bottoms product. The heavy liquid residue contains substantially all of the sludge and metal products separated from the waste lube oil thus leaving as the overhead product the clean lubestock which is reusable in any of a variety of applications. The amount of sludge which is produced, however, is considerably reduced from that produced in prior art procedures.

It is anticipated that the ebullated bed reactor would operate at temperatures of 700°F to 950°F and at pressures of 1,000–3,000 psi. The amount of hydrogen which is employed in such an operation would range from about 1 to about 20 standard cubic feet per pound of lube oil feed. Generally it is preferred that for ordinary waste lube oil from automobile engines, i.e. crankcase oil, the reactor conditions are relatively mild such that the temperature is 700°–750°F, the pressure is 1,000–1,500 psi and the hydrogen concentration is 1–5 standard cubic feet per pound of hydrocarbon feed. It is preferable if the catalyst has a particle size of 3–60 mesh and may be of any chemical constitution which has been found suitable for hydrogenation processes.

DETAILED DESCRIPTION OF THE INVENTION

The invention will be described in greater detail in conjunction with the accompanying drawing which is a simplified schematic flow sheet representing a preferred embodiment of the process. The feed stock is a waste lube oil which may be any of a wide variety of products employed as lubricants in automotive engines or in various industrial operations such as rolling mills, machines employing cutting oils, etc. Such a feed stock is generally accumulated in a large storage tank which is not shown on this drawing and as desired is fed through line 10 into heater 12 which preheats the feed material to the temperature maintained in the ebullated bed reactor. Generally this temperature will be from about 700°F to about 950°F. Hydrogen or a hydrogen-rich gas is fed under pressure from a suitable storage container now shown in this drawing through line 11 to heater 13 which provides the necessary heat to raise the temperature of the hydrogen gas to that of the reacting mixture in the ebullated bed reactor. As mentioned above, the temperature should be in the range of 700°F to about 950°F, and the pressure should be from 1,000 to 3,000 psi. The compressed hydrogen gas and the heated lube oil feed are combined in line 15 and fed into ebullated bed reactor 16. By a suitable pump or mixing device which is not shown the mixture of lube oil and hydrogen and catalyst particles are circulated in reactor 16 in such a fashion that the catalyst particles all remain below the level shown at 17 and circulate throughout the reactor with a random motion. Above line 17 there is a liquid layer which is substantially free of catalyst particles and from which a liquid product is withdrawn through outlet 21 into line 22. Above all of the liquid in reactor 16 there is a vapor space 18 which is substantially free of liquid and from this space a vapor is withdrawn through line 23. New catalyst particles may be continuously or intermittently introduced into reactor 16 through line 19 and spent catalyst particles may be continuously or intermittently removed from reactor 16 through line 20. The catalyst employed in this process is a demetallization catalyst which efficiently and effectively removes the metal components from the lube oil and permits these metal components to be separated from the system in a later stage of the process. As mentioned above the reaction conditions maintained in reactor 16 are that the temperature is 700°–950°F, the pressure is 1,000–3,000 psi, and the hydrogen feed rate is 1–20 standard cubic feet per pound of waste lube oil feed. In most situations where the feed is substantially all from an automotive source the conditions in the reaction can be relatively mild and it is preferred that the temperature be 700°–750°F, the pressure 1,000–1,500 psi and the hydrogen feed rate 1–5 standard cubic feet per pound of lube oil feed.

The vapor leaving reactor 16 through line 23 is cooled in heat exchanger 24 and passed through line 25 into separator 26. Separator 26 performs the function of separating liquids from gases, the gases passing overhead through line 27 and line 38 to be recycled through line 30 or passed into hydrogen purification unit 29. The liquid accumulating in the bottom of separator 26 is withdrawn through line 28 to become a part of the clean lubestock product. Most of the vapors and gases removed from the top of reactor 16 comprise unused hydrogen and some light hydrocarbon materials. These vapors and gases with or without purification, are recycled through line 30, and may be pressurized by compressor 14 to the reactor pressure before joining the hydrogen feed entering heater 13.

The liquid product withdrawn from reactor 16 through line 22 is the hydrogenated lube oil. The hydrogenation reforms and saturates some of the degraded hydrocarbon material in the waste lube oil feed and also reacts with some of the metal to form metallic products which can be separated from the liquid hydrocarbon. The liquid product in line 22 is fed into flash evaporator 31 where dissolved gases and vapors are released and removed overhead through line 32 to join the vapors and gases entering hydrogen purification unit 29. The remaining liquid in flash evaporator 31 which has been freed of dissolved vapors and gases is removed through line 33 and fed to vacuum distillation unit 34 which performs the normal distillation separation operation. The overhead product from this distillation operation is the clean lubestock which results from the removal of metals, sludge, and other heavy asphaltic and resinous products into a bottoms which is removed through line 37. The clean hydrocarbon lubestock is removed through line 35 and joined with the small amount of liquid product in line 28 to produce in line 36 the clean lubestock product of this invention. The heavy liquid residue in line 37 may receive further treatment, not shown in this drawing to recover the metals from this product and to utilize the heavy hydrocarbon material in whatever manner is desirable.

The flow sheet in this drawing is intended to be a simplified version of this invention and it is not intended that the invention be limited in any fashion by this drawing. It is possible, for example, that the product in line 35 be subjected to fractional distillation to provide a variety of light-to-heavy hydrocarbon products known to be useful for various applications. Still another embodiment would be to employ a multiple stage reaction wherein two or more ebullated bed reactors such as that shown at 16 are operated in series to perform a more complete hydrogenation and to produce a different variety of products. Still another embodiment of this invention is to treat the heavy liquid residue in line 37 to a partial oxidation process to produce further hydrogen for use in the feed of this invention. Futhermore, the heavy liquid residue in line 37 may be separated in such a fashion that some of the hydrocarbon material may be employed as a fuel for any suitable application, e.g. the firing of heaters 12 and 13 or the heating of the steam-methane reactor mentioned above. It should be clearly understood that these embodiments and others which may occur to those skilled in the art are intended to be included within the scope of this invention.

Although the invention has been described in considerable detail with reference to certain preferred embodiments thereof, it will be understood that variations and modifications can be affected within the spirit and scope of the invention as described hereinabove and as defined in the appended claims.

What is claimed is:

1. The process of hydrotreating a waste lube oil to prepare a clean lubestock which comprises contacting said oil in liquid phase with a hydrogen rich gas in a contact zone containing an ebullated bed of a particulate demetallization hydrogenation catalyst of from 3 to 60 mesh and at a hydrogen pressure of 1000 to 3000 psi and at a temperature of 700° to 950°F while maintaining a hydrogen rich gas velocity in the order of 1 to 20 standard cubic feed per pound of hydrocarbon charge, withdrawing a reaction effluent containing a substantial amount of liquid from the upper part of the contact zone and separating that effluent by vacuum distillation to produce a clean lubestock and a heavy residue containing sludge and heavy metals from said waste lube oil.

2. The process of claim 1 wherein said process is 1000–5000 psi, said temperature is 700°–750°F and said velocity is from about 1 to about 5 standard cubic feet per pound of hydrocarbon charge.

3. The process of claim 1 wherein said reaction effluent is flash evaporated to remove hydrogen and light vapors from the remaining liquid which is thereafter distilled under vacuum.

* * * * *

UNITED STATES PATENT AND TRADEMARK OFFICE

CERTIFICATE OF CORRECTION

PATENT NO. : 3,980,551

DATED : September 14, 1976

INVENTOR(S) : Ronald H. Wolk

It is certified that error appears in the above-identified patent and that said Letters Patent are hereby corrected as shown below:

In Column 6, line 9, "1000 to 5000" should read -- 1000 to 1500 --.

Signed and Sealed this

First Day of February 1977

[SEAL]

*Attest:*

RUTH C. MASON
*Attesting Officer*

C. MARSHALL DANN
*Commissioner of Patents and Trademarks*